US005509344A

United States Patent [19]

Calabrese et al.

[11] Patent Number: 5,509,344

[45] Date of Patent: Apr. 23, 1996

[54] MEMBER WITH SYNTHETIC SURFACE REPLICATING A SURFACE OF A SPECIMEN OF A NATURAL MATERIAL

[75] Inventors: Salvadore J. Calabrese, Clifton Park; Henry A. Scarton, Troy; S. Frank Murray, Clifton Park; Christopher M. Ettles, Glenmont; Warren C. Kennedy, Feura Bush; Saim Dinc; Bessem Jlidi, both of Troy, all of N.Y.; William Strong, Stamford, Conn.

[73] Assignees: Rensselaer Polytechnic Institute; Steinway Musical Properties, Inc., both of Troy, N.Y.

[21] Appl. No.: 361,715

[22] Filed: Dec. 22, 1994

Related U.S. Application Data

[60] Continuation of Ser. No. 118,042, Sep. 8, 1993, abandoned, which is a division of Ser. No. 930,487, Aug. 14, 1992, Pat. No. 5,265,515, which is a continuation of Ser. No. 696,600, May 7, 1991, abandoned, which is a continuation-in-part of Ser. No. 525,468, May 18, 1990, Pat. No. 5,183,955.

[51] Int. Cl.[6] ..... G10C 3/12; A41G 1/02; B22C 9/22

[52] U.S. Cl. ..... 84/437; 249/55

[58] Field of Search ..... 84/437, 438, 439, 84/452 P, 433; 249/55

[56] References Cited

U.S. PATENT DOCUMENTS

| | | | |
|---|---|---|---|
| 174,000 | 2/1876 | Pratt | 84/437 |
| 271,120 | 1/1883 | Rikeman | 84/437 |
| 2,779,058 | 1/1957 | Hyde | 249/55 |
| 2,844,065 | 7/1958 | Corwin | 84/438 |
| 3,031,910 | 5/1962 | Lofaro | 84/453 |
| 3,032,455 | 5/1962 | Fauser | 84/437 |
| 3,060,074 | 10/1962 | Good | 84/438 |
| 4,346,639 | 8/1982 | Vagias | 84/437 |
| 4,419,921 | 12/1983 | Simanski | 84/467 |
| 4,508,575 | 4/1985 | Oshima | 106/148 |
| 4,840,104 | 6/1989 | Ishida et al. | 84/437 |

FOREIGN PATENT DOCUMENTS

| | | |
|---|---|---|
| 0323425 | 7/1989 | European Pat. Off. . |
| 2446519 | 4/1976 | Germany . |
| 62-158757 | 7/1987 | Japan . |

*Primary Examiner*—Cassandra C. Spyrou
*Attorney, Agent, or Firm*—Fish & Richardson

[57] ABSTRACT

A piano key cover having a body of synthetic material pigmented to resemble natural ivory defines a top playing surface having a random orientation of peak-to-valley texture and a multiplicity of fine pores to replicate a surface of natural ivory. A multiplicity of the pores have diameters generally in the range of 0.0002 to 0.0012 inch (0.005 to 0.030 mm). The synthetic material is selected from the group consisting of acrylic polymer, polyurethane, epoxy and the like. A method for forming such a piano key cover and a piano having key covers of the invention are also described.

1 Claim, 8 Drawing Sheets

| Material | Test Load (W) | Test Speed U (1) (0.6cm/sec) | (2) (2cm/sec) | (3) (6cm/sec) |
|---|---|---|---|---|
| Plexiglass Rα=0.033μm | 1. (100-150 gr) | 0.62±0.08 | 0.45±0.06 | 0.38±0.03 |
| | 2. (300-400 gr) | 0.55±0.05 | 0.38±0.05 | 0.34±0.07 |
| | 3.(1000-2000gr) | 0.40±0.05 | 0.32±0.04 | 0.25±0.06 |
| Nylon 66 Rα=0.63μm | 1. | 0.41±0.06 | 0.33±0.06 | 0.25±0.03 |
| | 2. | 0.37±0.05 | 0.28±0.04 | 0.23±0.04 |
| | 3. | 0.23±0.04 | 0.23±0.03 | 0.18±0.05 |
| Teflon Rα=1.9μm | 1. | 0.12±0.05 | 0.07±0.05 | 0.08±0.05 |
| | 2. | 0.09±0.06 | 0.12±0.05 | 0.08±0.04 |
| | 3. | 0.10±0.03 | 0.13±0.04 | 0.09±0.04 |
| Polycarbonate Rα=1.9μm | 1. | 0.82±0.09 | 0.58±0.07 | 0.43±0.05 |
| | 2. | 0.59±0.06 | 0.54±0.04 | 0.44±0.06 |
| | 3. | 0.51±0.08 | 0.37±0.05 | 0.30±0.05 |
| Phenolic Rα=1.4μm | 1. | 0.58±0.07 | 0.46±0.07 | 0.33±0.05 |
| | 2. | 0.50±0.08 | 0.45±0.06 | 0.29±0.05 |
| | 3. | 0.38±0.08 | 0.35±0.07 | 0.30±0.04 |
| Ground Ivory | 1. (100-200 gr) | 0.97±0.08 | 0.58±0.06 | 0.29±0.05 |
| | 2. (300-400 gr) | 0.84±0.07 | 0.53±0.07 | 0.20±0.05 |
| | 3.(1000-2000gr) | 0.57±0.07 | 0.43±0.05 | 0.21±0.06 |
| Old Ivory | 1. (100-200 gr) | 0.67±0.01 | 0.58±0.11 | 0.38±0.07 |
| | 2. (300-400 gr) | 0.64±0.08 | 0.56±0.08 | 0.34±0.06 |
| | 3.(1000-2000gr) | 0.59±0.11 | 0.48±0.06 | 0.42±0.08 |
| New Ivory (Polished) Rα=0.19μm | 1. | 0.67±0.07 | 0.45±0.07 | 0.32±0.04 |
| | 2. | 0.35±0.06 | 0.39±0.06 | 0.23±0.08 |
| | 3. | 0.31±0.06 | 0.26±0.04 | 0.18±0.08 |
| RPIvory (Unpolished) Rα=1.09μm | 1. | 0.63±0.08 | 0.56±0.09 | 0.42±0.10 |
| | 2. | 0.36±0.09 | 0.37±0.07 | 0.28±0.06 |
| | 3. | 0.32±0.07 | 0.31±0.06 | 0.24±0.04 |
| Yamaha Artificial Ivory Ivory | 1. | 0.68±0.08 | 0.42±0.09 | 0.38±0.08 |
| | 2. | 0.50±0.07 | 0.32±0.07 | 0.22±0.08 |
| | 3. | 0.40±0.07 | 0.19±0.04 | 0.24±0.09 |
| Kawai Artificial Ivory | 1. | 0.84±0.08 | 0.55±0.08 | 0.46±0.08 |
| | 2. | 0.42±0.08 | 0.37±0.05 | 0.31±0.03 |
| | 3. | 0.32±0.06 | 0.27±0.06 | 0.23±0.89 |

FIG. 9A

| Side | Comments Stick-Slip | Feel |
|---|---|---|
| Slippery | Some | Good |
| Slippery | Some | Unpleasant |
| Slippery | None | Unpleasant |
| Firm | Severe | Good |
| Slippery | Firm | Good |
| Slippery | High | Good |
| Slippery | Some | Good |
| Slippery | Some | Good |
| Slippery | Some | Good |
| Slippery | Some | Good |
| Slippery | Some | Good |

FIG. 9B

Table X

Friction Coefficients & Wear Volumes of Some Key-Cover Materials

| | Yamaha | Ivory | RPIvory ™ |
|---|---|---|---|
| Dry (After 500 Strokes) → $\mu$ | 0.470 ± 0.070 | 0.550 ± 0.060 | 0.480 ± 0.060 |
| Baby Oil (After 500 Strokes) → $\mu$ | 0.350 ± 0.050 | 0.320 ± 0.060 | 0.340 ± 0.050 |
| Baby Oil (After 800,000 Strokes) → $\mu$ | 0.172 ± 0.040 | 0.183 ± 0.040 | 0.177 ± 0.050 |
| Steinway Wax (Dry) (After 500 Strokes) → $\mu$ | 0.406 ± 0.060 | 0.398 ± 0.050 | 0.403 ± 0.050 |
| Total (After 900,000 Strokes) Wear Volume – ($mil^3$) | 28,540 (0.462 $mm^3$) | 98,923 (1.610 $mm^3$) | 18,768 (0.306 $mm^3$) |

FIG. 11

CLEANING CHARACTERISTICS OF VARIOUS IVORY CANDIDATES
MEASURES BY REFLECTIVITY

| CLEANING MATERIAL | NATURAL IVORY | REPLICA IVORY | IVOPlast |
|---|---|---|---|
| POLISHED | 33.0 | 41.5 | 39.5 |
| 409 DETERGENT | 31.5(1) | 40.0(1) | 38.5(1) |
| HASCHEPUR | 32.0(1) | 41.0(1) | 39.0(2) |
| METHANOL | 32.0(1) | 42.0(1) | 38.0(2) |
| BON AMI | 31.0(3) | 40.0(3) | 35.0(2) |
| TOUGH DUTY | 32.0(1) | 40.0(2) | 36.0(2) |
| BORAXO | 32.5(1) | 40.0(2) | 36.0(2) |
| MENZERNA-WERK | 36.0(1) | 40.5(2) | 37.0(2) |

(1) MARK LIGHT BUT STILL VISIBLE
(2) MARK NOT VISIBLE
(3) MARK NOT VISIBLE, SURFACE DULL

FIG. 12

MEMBER WITH SYNTHETIC SURFACE REPLICATING A SURFACE OF A SPECIMEN OF A NATURAL MATERIAL

CROSS REFERENCE TO RELATED APPLICATIONS

This application is a continuation of U.S. Ser. No. 08/118,042 filed Sep. 8, 1993 now abandoned which is a divisional of U.S. Ser. No. 07/930,487 filed Aug. 14, 1992 now U.S. Pat. No. 5,265,515 which is a continuation of U.S. Ser. No. 07/696,600 filed May 7, 1991 now abandoned which is a continuation in part of U.S. Ser. No. 07/525,468 now U.S. Pat. No. 5,183,955.

BACKGROUND OF THE INVENTION

The invention relates to articles formed of synthetic material, but replicating a natural material, and in particular to piano key covers formed of synthetic ivory substitute material.

It has been the practice, for centuries, to manufacture piano key covers from natural ivory. In more recent years, initially due to concerns of cost and more recently due to concerns of wildlife conservation, it has been proposed to substitute synthetic plastic materials which have the appearance of natural ivory, see, e.g., Ishida U.S. Pat. No. 4,840,104 and Vagia U.S. Pat. No. 4,346,639. However, it has been found by experienced pianists that the feel of piano key covers of natural ivory differs significantly from that of key covers formed of synthetic material, and that the quality of their performance on pianos having key covers of synthetic material is perceptibly diminished.

SUMMARY OF THE INVENTION

According to one aspect of the invention, a piano key cover is formed of a synthetic material pigmented to resemble natural ivory and has a top playing surface with a random orientation of peak-to-valley texture and a multiplicity of fine pores, replicating that of natural ivory.

Preferred embodiments of this aspect of the invention may include one or more of the following features. A multiplicity of the pores have diameters generally in the range of 0.0002 to 0.0012 inch (0.005 to 0.030 mm). The synthetic material is selected from the group consisting of polyurethane, acetate polymer, epoxy, and the like.

According to another aspect of the invention, a piano key cover of synthetic material is formed by the method comprising of casting, molding or injection molding, providing a mold for a piano key cover having a surface formed with a randomly-oriented pattern of peak-to-valley texture replicating that characteristic of natural ivory, placing in the mold a composition comprising a suitable synthetic material pigmented to resemble natural ivory and a filler, the filler being a leachable solid having the characteristic of being removable from a molded article by further treatment, forming a piano key cover within the mold, and treating the piano key cover to remove the filler thereby causing the surface of the piano key cover to define a plurality of fine pores, replicating the surface of natural ivory.

Preferred embodiments of this aspect of the invention may include one or more of the following features. The mold can be an elastomeric material, such as silicone rubber. The removable filler comprises polyethylene glycol (PEG), preferably having a particle size of about 1 micron. A multiplicity of the pores have diameters generally in the range of 0.0002 to 0.0012 inch (0.005 to 0.030 mm). The synthetic material is selected from the group consisting of polyurethane, acetate polymer, epoxy, and the like.

According to other aspects of the invention, a piano comprises a piano key cover as described above, and may be formed generally according to the method described, with the additional steps of thereafter mounting the piano key cover upon a key board base and assembling the piano.

In another aspect, the invention features a grip member having a body comprising synthetic material. The body defines a surface exposed for tactile contact. The surface has a predetermined level of fine porosities and a predetermined level of surface peak-to-valley texture.

The invention thus provides, particularly, a synthetic ivory piano key cover that replicates natural ivory, including with respect to surface roughness, surface texture, porosity, color and touch or feel.

Objectives of the invention include providing a wear resistant, easily cleanable synthetic material for piano key covers having the appearance and feel of natural ivory, even to experienced pianists; and also providing a method for forming a piano key cover of the invention, and providing a piano having key covers of the invention.

These and other features and advantages of the invention will be seen from the following description of a presently preferred embodiment, and from the claims.

DESCRIPTION OF PRESENTLY PREFERRED EMBODIMENT

We first briefly describe the drawings.

Figure 10:
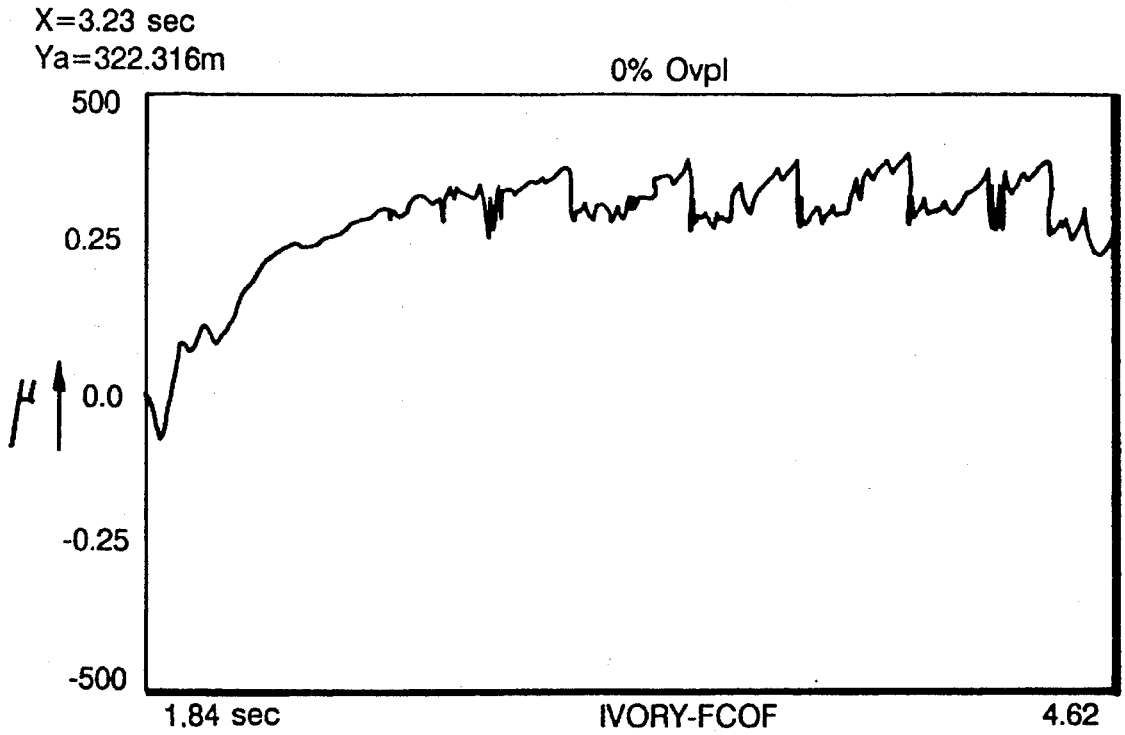

FIGS. 9A and 9B compares the tactile friction of key covers of various materials;

FIGS. 10 and **10*a*** are graphs of friction versus time for natural ivory and synthetic ivory material according to the invention, respectively;

FIG. 11 compares the coefficients of friction and wear characteristics of commercially available synthetic ivory, natural ivory and a material formed according to the invention; and FIG. 12 compares the cleanability of various key covers.

Figure 1:
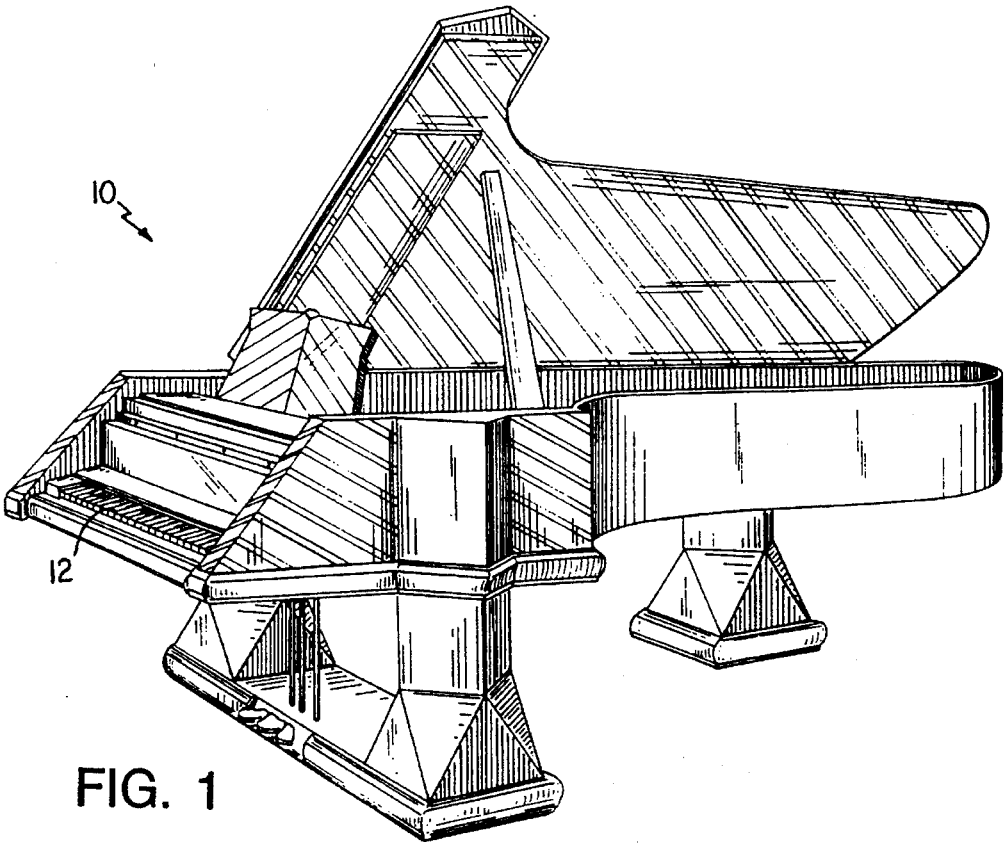
FIG. 1 is a perspective view of a grand piano having piano key covers of the invention.
Figure 2:
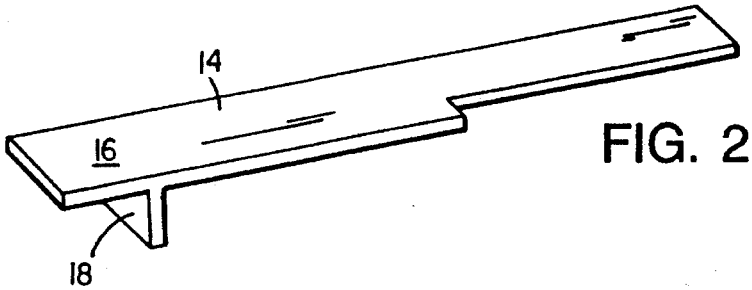
FIG. 2 is an enlarged perspective view of a piano key covers of the invention.

Referring to FIG. 1, there is shown a grand piano 10 having piano keys 12 with piano key covers 14 of the invention. Referring also to FIG. 2, a piano key cover 14 includes a top surface 16 and a front surface 18, and is sized and constructed to be fixed upon a keyboard base (not shown), formed, e.g. of wood.

The piano key covers 14 of the invention are formed of a suitable synthetic material, molded to look and feel like natural polished ivory by creation of a surface having predetermined characteristics of roughness, texture and porosity that replicate that of natural ivory.

Figure 3:
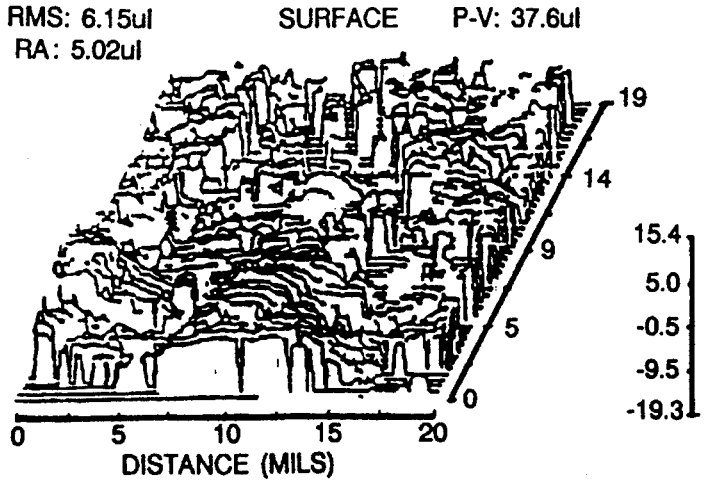
FIG. 3 is a three dimensional plot of surface texture for a sample of natural ivory.

As shown in FIG. 3, the top surface 16 of the key cover 14 of the invention reproduces the random orientation of surface peak-to-valley texture that is characteristic of natural ivory, as seen in the three dimensional plot of surface texture for a sample of natural ivory. The porosity of the key covers 14, like that of natural ivory, provides means to channel the perspiration and humidity from the artist's fingers to avoid variations in the coefficient of friction during the course of play, an important characteristic of natural ivory. In preferred embodiments, the synthetic key cover 14 also provides improved wear characteristics, resulting in key covers with much improved life. The key covers 14 may also be easily cleaned by conventional techniques.

According to the invention, the key covers 14 are formed of a synthetic material, e.g. acrylic, polyurethane, epoxy, or the like, preferably pigmented to duplicate the color and appearance of natural ivory, e.g., with titanium dioxide ($TiO_2$), calcium oxide (CaO), aluminum oxide ($Al_2O_3$) or combinations of the above.

The key covers 14 are manufactured by e.g. molding, casting or injection molding in a mold having molding surfaces formed complementary to the surface of an actual piano key cover of natural ivory. A natural ivory key cover is used as a master for forming multiple molding cavities prepared using a suitable material such as a low viscosity elastomer, e.g., silicone rubber (RTV), or a replicating metal mold by which a complementary replication of the surface of the natural ivory key may be reproduced with accuracy down to a micro-scale. The mold cavity thus formed is used to create a piano key cover 14 of the invention by placing material to form a synthetic key cover 14 into the mold. The key cover material is mixed (preferably prior to pouring into the mold) with a leachable solid filler material which has a small particle size and which may be removed from the molded key cover preform, e.g. by application of heat or solvent. Suitable filler materials include, e.g., polyethylene glycol (PEG) having a particle size of about 1 micron. After molding, the key cover preform is treated, e.g. by heating or solvent, as appropriate, to remove the particles of filler material from the body of the piano key cover, leaving a plurality of micro-pores in the surface 16 of the key cover 14, thereby replicating the large quantity of fine pores, typically between 0.0002 and 0.0012 inch diameter (0.005 to 0.030 mm), found in natural ivory.

The molded piano key cover 14 of the invention may then be mounted upon a key board base for assembly in a piano 10.

One particular laboratory scale method for forming piano key covers 14 of the invention will now be described, by way of example only.

EXAMPLE 1: CASTING TECHNIQUES

A polished natural ivory key was used in a process for reproducing its surface characteristics in a mold formed by a room temperature vulcanizing process with a low viscosity silicone rubber compound (GE RTV21, available from General Electric Co. of Waterford, N.Y.) in solution with a hardener (GE RTV2I hardener, also available from General Electric Co.) to induce the setup process.

Figure 4:
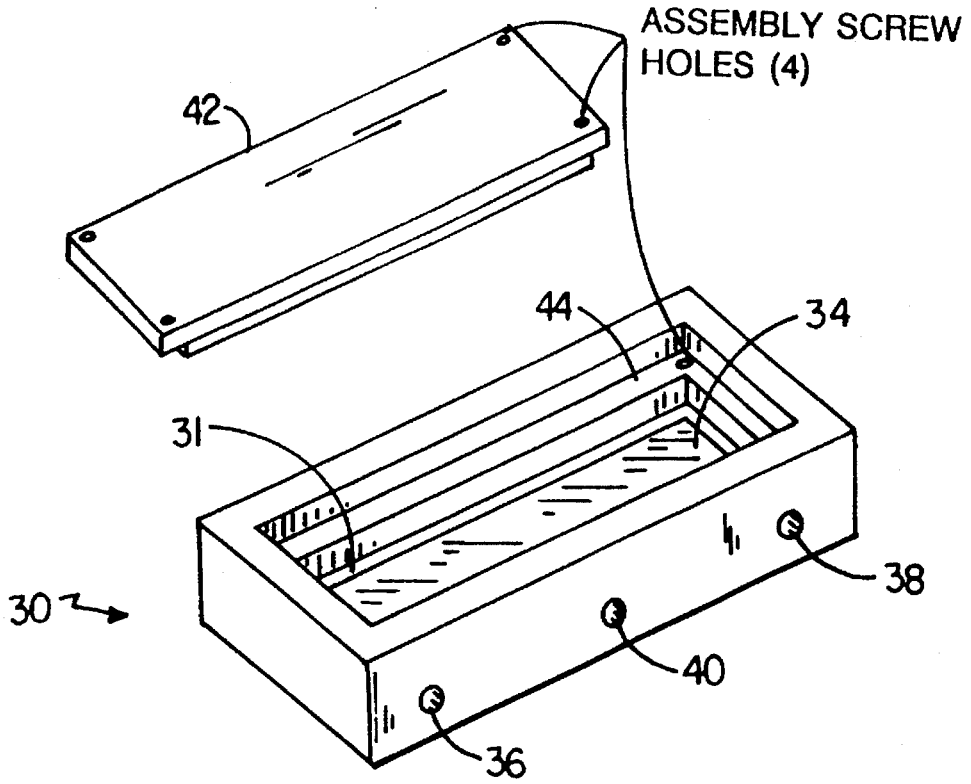
FIG. 4 is a plan view of a mold apparatus for casting the surface of a natural ivory key and molding key covers of the invention.
Figure 5:
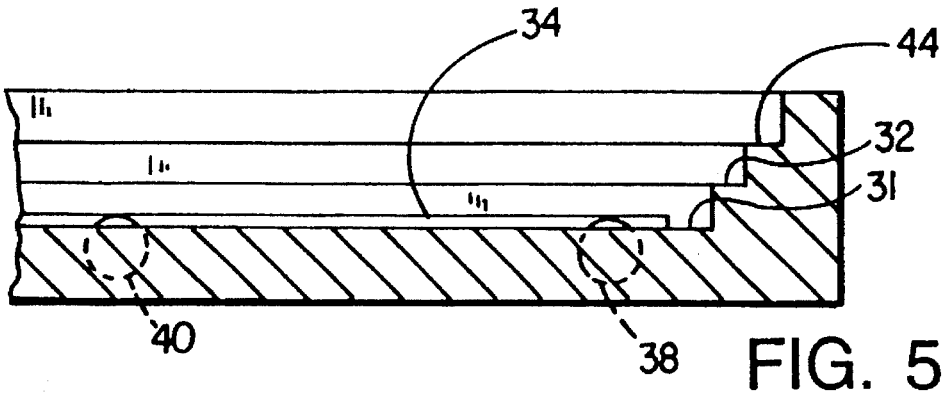
FIG. 5 is a partial cross-sectional view of the mold apparatus of FIG. 4; while FIG. **5*a*** is a side view of a plug for use with the mold.

The piano key cover of natural ivory to be used as a master was cleaned using a mild detergent (e.g. Ivory® soap) and warm water. The specimen was then polished using a standard polishing compound, e.g. available from Menzerna-Werke of Germany. An aluminum casting mold as shown in FIGS. 4 and 5 was employed to cast a replica of the surface of the natural ivory key cover and to mold the piano key covers 14 of the invention. The mold 30 has a stepped surface 31 and recessed surface 32 to accommodate the natural ivory piano key cover 34 in a face-up configuration. The mold has venting holes 36, 38 and a pouring hole 40 formed in its side. These holes were plugged during the natural ivory surface casting step. The mold has a cover 42 which mates with steps 44 to retain the rubber mold in the replica injection molding step, as will be further described below.

The preparation of the silicone rubber compound (GE-RTV21) is now described. A mixing glass cup was placed on a precision scale and its tare weight determined. The silicone rubber compound was then poured into the cup and weighed. The silicone hardener was added (0.5% by weight) to the silicone rubber compound and mixed thoroughly for 2 minutes. The mixture was then poured into the casting mold which was already placed and leveled in a see-through vacuum chamber. A vacuum pump (capable of at least 28.0 inch (71.1 cm) Hg) was turned on for 20 minutes. The casting mold was then removed from the vacuum chamber and placed into a pressure chamber (regulated filtered air chamber capable of at least 30 psi (2.1 kg/cm$^2$)). The casting mold was again leveled and left under 20 psi (1.4 kg/cm$^2$) of gauge pressure for 24 hours. The key cover rubber mold was then carefully removed from the casting mold and covered to avoid contamination of the finished ivory key cover casted surface. Care was taken throughout to keep surfaces dust-free.

Fabrication of the piano key cover 14 of the invention was accomplished using fresh ingredients to avoid sensitivity to humidity and limited shelf life. The fabrication process was carried out in a well ventilated laboratory hood due to the toxic fumes generated during the mixing process. In the present example, the piano key cover was formed using a butyl glycidyl ether (B.G.E.) modified epoxy resin (HYSOL RE2038, available from the Dexter Electronics Materials Division of The Dexter Corporation, Industry, California) and an amine hardener (HD3404, available from the Hysol Division of The Dexter Corporation); a pigment of comprising titanium dioxide (TI-PURE® R960 Rutile Titanium Dioxide (89% min by weight $TiO_2$, 3.5% max by weight $Al_2O_3$, 6.5% max by weight $SiO_2$), available from E.I. du Pont de Nemours & Co. (Inc.), Wilmington, Del.); and, as a soluble filler material, polyethylene glycol powder having an average particle size of about one micron (CARBOWAX Brand SENTRY Polyethylene Glycol 3350, available from the Specialties Chemical Division of Union Carbide Corporation).

Figure 5A:
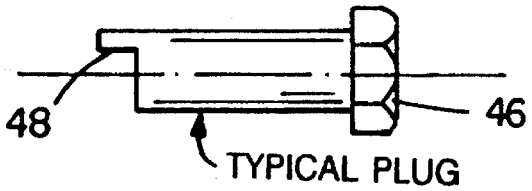

After an elastomeric key cover mold was prepared according to the steps described above, the mold was cleaned using a precision duster and placed into the aluminum casting mold and glued in place. The step 31 surrounding the recessed surface where the key cover mold is placed prevents the rubber material from overflowing in the air vacuuming stage, to be further discussed (FIG. 5). The pouring 40 and venting holes 36, 38 were plugged using special bolts 46 having a lip 48 to engage the surface 31 (FIG. 5*a*).

To mix the synthetic material that forms the key cover, the tare of the mixing cup was determined and the RE2038 resin was poured into the mixing cup using a measuring pipette until a net weight of 20 grams was achieved. Ten percent (i.e., 2.0 grams) of dried R960 titanium dioxide was added to the resin. One percent (i.e., 1.0 gram) of dry PEG3350 Carbowax filler was then added to the mixture. Using the electric stirrer, the mixing cup was removed from the scale and the mixture stirred thoroughly for approximately 30 seconds. The mixing cup was then placed back on the scale and the scale reset. Ten percent (i.e., 2 grams) of HD3404 hardener was then added to the mixture and time is recorded. The mixing cup was finally removed from the scale and stirred vigorously for 30 seconds. Generally, the resin started to harden and ceased to be fluid within two hours from the time the hardener was added.

To remove air bubbles, a vacuum pump lid was tightly closed on the cup containing the mixture compound and the pump started. Time was recorded and the progress of the air removal process was monitored for the next 20 minutes. Generally, the thinner the specimen, the less time it took to remove the trapped air bubbles, assuming that the mixing times were held constant. At the time the vacuum pump was started, tiny air bubbles began forming at the surface. These were joined by larger bubbles from below the surface culminating into a growing foam which dissipated rather quickly after reaching a maximum height. After 20 minutes of vacuuming time, the number of air bubbles at the surface was reduced greatly, signaling that most of the entrapped air was removed. The vacuum pump was stopped and air was let into the vacuum chamber slowly to avoid formation of asperities on the surface due to rapid change of air pressure in the container.

The mixture was then poured slowly into the pouring hole of the casting mold. To pressurize the mold, the mold was put into a pressure chamber to insure a close adherence of the mixture to the finished surface of the mold as the mixture set. After the lid was closed, compressed air was let in slowly, building pressure in the mold to approximately 20 psi (1.4 kg/cm$^2$). After 24 hours from the time the hardener was added, the aluminum housing and casting mold containing the specimen was removed from the pressure chamber. The specimen was removed using a 90° knife edge. The excess edges were then filed off the specimen. The specimen was weighed, and then washed and left in distilled water for the next 24 hours to remove the Carbowax filler to provide the desired porosity of the surface.

In general, it has been found that the first piano key cover 14 produced from a given elastomeric mold may contain imbedded contamination believed to be picked up from the mold. Surface tackiness of the piano key cover, believed to be due to water absorbed by the amine hardener under humid conditions, can be removed by simple cleaning, e.g., with a suitable compound such as available from Menzerna-Werke, of Germany.

The key cover 14 may then be attached to a wooden key base using an appropriate adhesive.

Experiments were conducted to compare the wearability and cleanability of piano key covers 14 of the invention, produced e.g., by the method described in Example 1, with natural ivory key covers and commercially available synthetic key covers.

WEAR AND FRICTION CHARACTERISTICS

A test apparatus was constructed to evaluate the wear characteristics of the various candidate key cover materials and compare them to natural ivory. The apparatus included a finger-shaped device of material which exhibited the hardness of a typical human finger, a motor and variable speed gear assembly to create a striking motion on a piano key cover held by a holder coupled with a transducer which measured the normal load on a continuous basis. In addition, a second triaxial transducer was used on a periodic basis to measure the friction force and the normal load simultaneously. The apparatus is fully discussed in "Some Parameters Affecting Tactile Friction", *Transactions of the ASME* (Volume 7–10, October 1990 at Toronto, American Society Mechanical Engineering, Tribolog Conference Paper No. 90-Trib. 28), the contents of which are hereby incorporated by reference.

The apparatus was capable of testing three materials simultaneously at various speeds and loads. For these tests the load was 6 pounds at 1 cycle per second.

Figure 6:
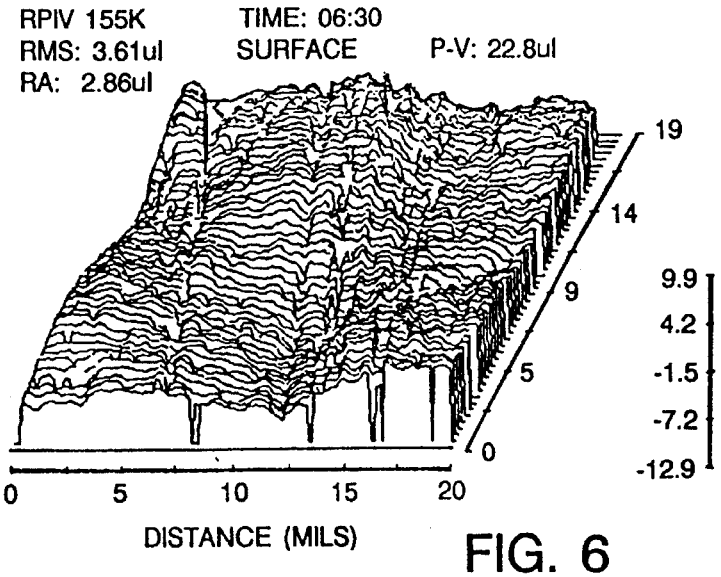
FIG. 6, 7 and 8 are three-dimensional plots of surface texture of a key cover according to the invention, a synthetic, commercial key cover, and a natural ivory key cover, respectively.
Figure 7:
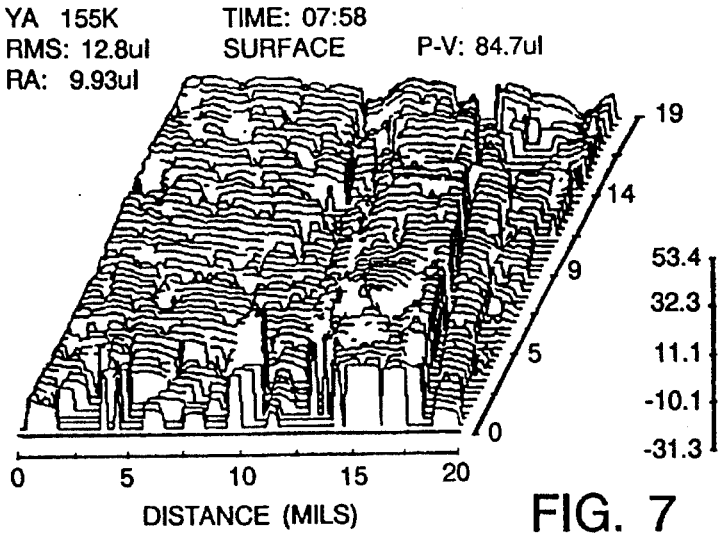
Figure 8:
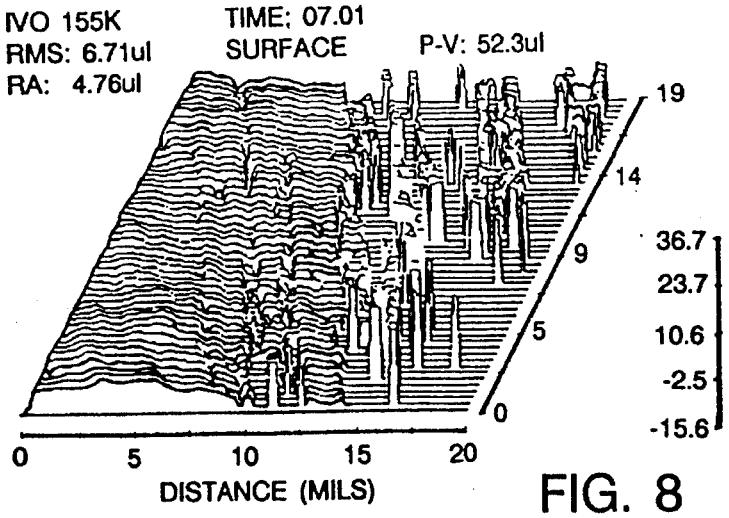

Three-dimensional plots of the surface wear scar after 155,000 cycles were generated for: (1) piano key covers formed according to the invention, (2) a commercially available plastic cover (e.g. as available from Yamaha Instruments) and (3) natural ivory are shown in FIGS. 6, 7 and 8, respectively. For the natural ivory key cover, the wear area exhibited wear depth greater than the capability of the optical profiler employed (Model TOP03D, available from Wyko). A line profiler (Model Form Rally-surf, available from Rank-Taylor-Hobson) using a contact profilometer was used to determine the depth of the wear scar at approximately 1400 μ-inch ($3.56\times10^{-2}$ mm). The peak-to-valley data for the key cover according to the invention indicate the wear scar depth of 22μ-inch ($5.6\times10^{-4}$ mm) and that for the commercially available key cover was 84 μ-inch ($21.3\times10^{-4}$ mm). Hence, the wear scar depth of the piano key cover formed according to the invention was less than that of the commercially available material, and insignificant compared to the performance of natural ivory.

Figure 10A:
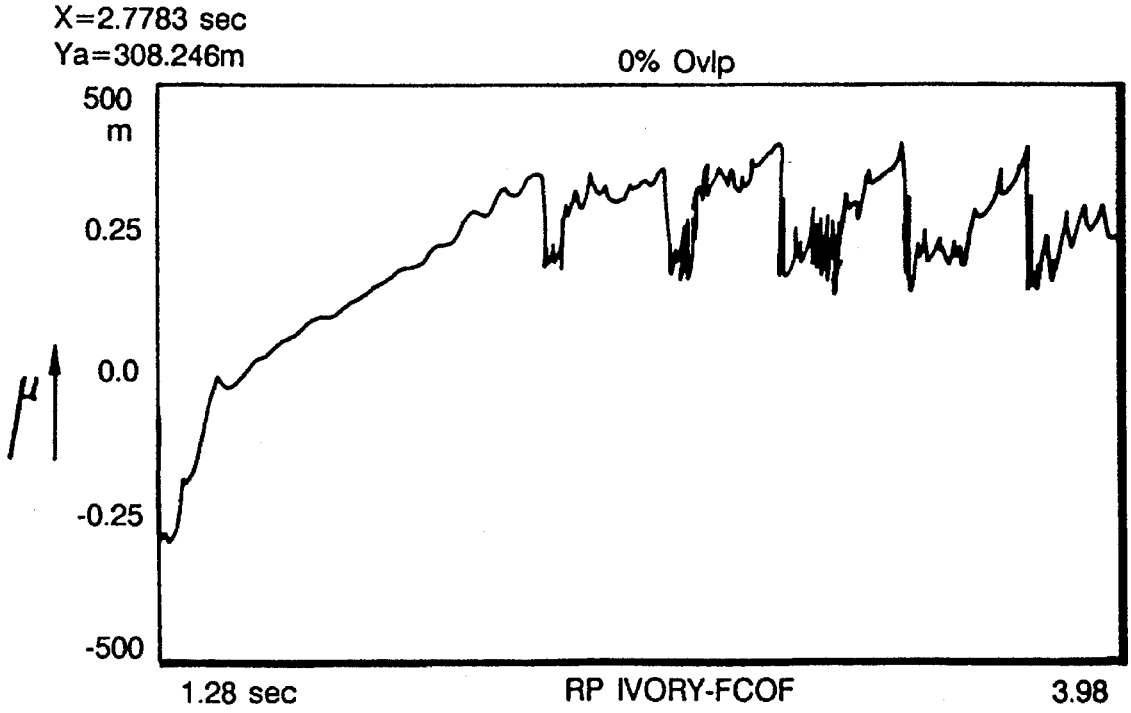

Referring to FIGS. 9A and 9B, friction measurements for piano keys formed of various materials including a sample of the material according to the invention (referred to in the figure as "RP Ivory") are shown. In FIGS. 10 and 10*a*, a friction plot of natural ivory and the synthetic ivory of the invention are compared under heavy load conditions (Ivory: 1550 gr, synthetic: 1300 gr; speed 0.6 cm/sec). The test conditions and apparatus are described in the aforementioned paper in Transactions of the ASME. As the results indicate, the friction measurements of the samples formed according to the invention compare favorably with natural ivory.

Referring to FIG. 11, friction results for commercial synthetic ivory, natural ivory and RPIvory are compared under dry conditions (500 strokes), with baby oil (after 500 and 8000,000 strokes), and with Steinway wax (dry, after 500 strokes); the wear volume after 900,000 strokes is also tabulated. In these tests, a leather finger was used for striking and humidity was 40%. As the results show, synthetic ivory according to the invention exhibited wear characteristics comparable to the natural ivory and wear volume was significantly less than the natural ivory and the commercial material.

CLEANABILITY

Several typical cleaning products were evaluated on natural ivory, IVOplast™ (a synthetic ivory material), and piano key covers formed according to the invention. The evaluation was performed by a Photonic sensor (Model KD238, available from MTI Inc.) to determine the change in surface reflectivity and visual inspection. The results are summarized in FIGS. 9A and 9B.

A mark formed with Flare® marking pen was put on the surface of each material and removed with the various candidate cleaning materials. The condition of the surface with respect to its reflectivity and visual condition was recorded. The number in each column in FIGS. 9A and 9B indicates the reflectivity. In addition, the number in parentheses identifies the visual condition of the surface. The final cleaning was with the wax compound supplied by Steinway & Sons (Long Island City, N.Y.), which did not remove all of the stain on the natural ivory but did remove most of the stain from both of the synthetic ivory key covers. After cleaning with Bon Ami, the surface of the ivory and the piano key cover 14 of the invention appeared dull due to the abrasive nature of the cleanser. However, it did remove all of the stain.

The results of the evaluation indicate that cleaning the surface of piano key covers 14 of the invention was less difficult than cleaning the natural ivory. All of the samples were less reflective after cleaning. The abrasive cleanser (Bon Ami) removed the stain completely, but left the surface dull due to its abrasive character. All of the other products evaluated (with the exceptions of 409™ detergent) completely removed the stain. Thus, the key covers of the present invention may be cleaned at least as easily as natural ivory.

Other embodiments of the invention are within the following claims. For example, the synthetic material forming the key covers 14 may be pigmented to create key covers of colors other than that resembling natural ivory.

It will also be understood that a material of the invention, having predetermined porosity and roughness may also be used, e.g., as a grip material, e.g. for computer/typewriter key tops, steering wheels, sport-related grips, e.g. tennis racket handles, fire arm grips, e.g., for pistols, and any other tactile surface. Various molding techniques and materials may also be employed. For example, for volume manufacturing, nickel molds engraved to replicate natural ivory or other surface may be employed.

What is claimed is:

1. A member having a body comprising synthetic material, said body defining a surface of synthetic material exposed for tactile contact, said surface of synthetic material having the random orientation of peaks and valleys found in a surface of a specimen of a predetermined material and defining a multiplicity of fine pores, a majority of said pores having a pore diameter of from 0.0002 to 0.0012 inch, said surface of synthetic material replicating said surface of said predetermined material.

* * * * *